US011085260B2

(12) United States Patent
AlAdawy et al.

(10) Patent No.: US 11,085,260 B2
(45) Date of Patent: Aug. 10, 2021

(54) WIRELINE-DEPLOYED ESP WITH SELF-SUPPORTING CABLE

(71) Applicant: Baker Hughes, a GE company, LLC, Houston, TX (US)

(72) Inventors: Ahmed AlAdawy, Dhahran (SA); Ameen Malkawi, Dhahran (SA); Brian Reeves, Edmond, OK (US); Michael Hughes, Oklahoma City, OK (US); Victor Acacio, Oklahoma City, OK (US); John Mack, Claremore, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 291 days.

(21) Appl. No.: 15/939,126

(22) Filed: Mar. 28, 2018

(65) Prior Publication Data

US 2018/0283384 A1 Oct. 4, 2018

Related U.S. Application Data

(60) Provisional application No. 62/477,935, filed on Mar. 28, 2017.

(51) Int. Cl.
*E21B 23/00* (2006.01)
*H01B 7/22* (2006.01)
(Continued)

(52) U.S. Cl.
CPC ..... *E21B 23/00* (2013.01); *F04D 13/021* (2013.01); *F04D 13/0693* (2013.01);
(Continued)

(58) Field of Classification Search
CPC ..... E21B 19/08; E21B 19/084; E21B 23/00; E21B 23/02; E21B 31/12; E21B 31/125; E21B 43/121; E21B 43/128
See application file for complete search history.

(56) References Cited

U.S. PATENT DOCUMENTS 3,853,430 A * 12/1974 O'Rourke ..... E21B 23/02 417/360
4,440,221 A * 4/1984 Taylor ..... E21B 34/08 166/106

(Continued)

OTHER PUBLICATIONS

International Search Report and Written Opinion issued in connection with corresponding PCT Application No. PCT/US2018/024977 dated Jul. 17, 2018.

*Primary Examiner* — Robert E Fuller
(74) *Attorney, Agent, or Firm* — Crowe & Dunlevy, P.C.

(57) ABSTRACT

A submersible pumping system for use in producing wellbore fluids from a wellbore within a subterranean formation includes a motor and a pump driven by the motor to produce the wellbore fluids. The pumping system further includes a self-supporting power cable connected to the pump. The self-supporting power cable includes a plurality of conductors and a plurality of strength members. A method of deploying and retrieving a submersible pumping system in a wellbore includes the steps of connecting a wireline to the submersible pumping system, connecting a self-supporting power cable to the submersible pumping system, lowering the submersible pumping system into the wellbore while the weight of the submersible pumping system is borne by the wireline. The method continues with the step of locating the submersible pumping system on a landing assembly, disconnecting the wireline from the submersible pumping system, and retrieving the wireline from the wellbore without removing the submersible pumping system from the wellbore.

8 Claims, 4 Drawing Sheets

(51) Int. Cl.

| | |
|---|---|
| ***F04D 13/08*** | (2006.01) |
| ***F04D 13/02*** | (2006.01) |
| ***F04D 13/06*** | (2006.01) |
| ***H01B 7/04*** | (2006.01) |

(52) U.S. Cl.
CPC ..... *F04D 13/086* (2013.01); *H01B 7/046* (2013.01); *H01B 7/223* (2013.01)

(56) References Cited

U.S. PATENT DOCUMENTS

| | | | | |
|---|---|---|---|---|
| 5,145,007 | A * | 9/1992 | Dinkins ..... | F04D 13/10 166/386 |
| 9,074,592 | B2 | 7/2015 | Morrison et al. | |
| 9,255,457 | B2 | 2/2016 | Scarsdale et al. | |
| 2010/0288501 | A1 | 11/2010 | Fielder et al. | |
| 2011/0240312 | A1 | 10/2011 | Varkey et al. | |
| 2012/0024543 | A1 | 2/2012 | Head | |
| 2013/0277042 | A1 | 10/2013 | Scarsdale et al. | |
| 2016/0194939 | A1 | 7/2016 | Lastra et al. | |

* cited by examiner

WIRELINE-DEPLOYED ESP WITH SELF-SUPPORTING CABLE

RELATED APPLICATIONS

This application claims the benefit of U.S. Provisional Patent Application Ser. No. 62/477,935 filed Mar. 28, 2017 entitled "Wireline-Deployed ESP with Self-Supporting Cable," the disclosure of which is herein incorporated by reference.

FIELD OF THE INVENTION

This invention relates generally to the production of hydrocarbons from a subterranean formation using an electric submersible pumping system, and more particularly, but not by way of limitation, to unconventional systems for deploying an electric submersible pumping system within a wellbore.

BACKGROUND

Submersible pumping systems are often deployed into wells to recover petroleum fluids from subterranean reservoirs. Typically, the submersible pumping system includes a number of components, including one or more electric motors coupled to one or more pumps. Each of the components and sub-components in a submersible pumping system is engineered to withstand the inhospitable downhole environment, which includes wide ranges of temperature, pressure and corrosive well fluids.

Conventional electric submersible pumping systems are connected to surface facilities through rigid production tubing. The pumping system and tubing are often run inside of a cased wellbore and the production fluids are pumped to the surface through the production tubing. Although widely adopted, the use of rigid production tubing presents several deficiencies. In particular, the use of long lengths of rigid production tubing requires a workover rig with sufficient height to retrieve and deploy the long sections of production tubing. Workover rigs are often expensive and difficult to source.

As an alternative to the use of rigid production tubing, pump manufacturers have designed systems in which an electric submersible pumping system is installed within the wellbore using a wireline deployment system. These prior art systems suffer from two significant deficiencies. First, many prior art wireline deployment systems have included a powered docking assembly at the lower end of the production tubing. In these systems, the power cable is banded to the production tubing and remains in the wellbore with the production tubing. The electric submersible pumping system is then lowered by wireline to the powered docking assembly. The connection between the docking assembly and the electric submersible pumping system is a "wet connection" that is subject to failure.

Second, in some prior art wireline deployment systems, the power cable is banded and supported by the wireline because the power cable cannot support its own weight. If the power cable is supported by the wireline, the wireline cannot be removed from the wellbore during use of the submersible pumping system. After prolonged exposure to corrosive wellbore chemicals, the wireline may corrode, fail and risk retrieval of the electric submersible pumping system.

There is, therefore, a need for an improved system and method for deploying an electric submersible pumping system by wireline within a subterranean well. It is to this and other deficiencies in the prior art that the present invention is directed.

SUMMARY OF THE INVENTION

In an embodiment, the present invention includes a submersible pumping system for use in producing wellbore fluids from a wellbore within a subterranean formation. The pumping system includes a motor and a pump driven by the motor to produce the wellbore fluids. The pumping system further includes a self-supporting power cable connected to the pump. The self-supporting power cable includes a plurality of conductors and a plurality of strength members.

In another aspect, the present invention includes a method of deploying and retrieving a submersible pumping system in a wellbore. The method includes the steps of connecting a wireline to the submersible pumping system, connecting a self-supporting power cable to the submersible pumping system, lowering the submersible pumping system into the wellbore. The weight of the submersible pumping system is borne by the wireline. The method continues with the step of locating the submersible pumping system on a landing assembly, disconnecting the wireline from the submersible pumping system, retrieving the wireline from the wellbore without removing the submersible pumping system from the wellbore, and providing electric current to the submersible pumping system through the self-supporting power cable.

In yet another aspect, the present invention includes a method of deploying and retrieving a submersible pumping system in a wellbore. The method includes the steps of connecting a self-supporting power cable to the submersible pumping system, lowering the submersible pumping system into the wellbore. The weight of the submersible pumping system is borne by the self-supporting power cable during the descent. The method continues with the step of locating the submersible pumping system on a landing assembly and providing electric current to the submersible pumping system through the self-supporting power cable.

In yet another aspect, the invention includes a method of deploying and retrieving a submersible pumping system in production tubing within a wellbore, where the begins with the step of connecting a wireline to the submersible pumping system. Next, the method includes the step of lowering the submersible pumping system into the production tubing, with the weight of the submersible pumping system being borne by the wireline during the descent. Next, the method includes the steps of locating the submersible pumping system on a landing assembly and disconnecting the wireline from the submersible pumping system. Next, the wireline is retrieved from the submersible pumping system and a self-supporting power cable is lowered to the submersible pumping system. The method then includes the steps of connecting the self-supporting power cable to the submersible pumping system and providing electric current to the submersible pumping system through the self-supporting power cable.

WRITTEN DESCRIPTION

Figure 1:
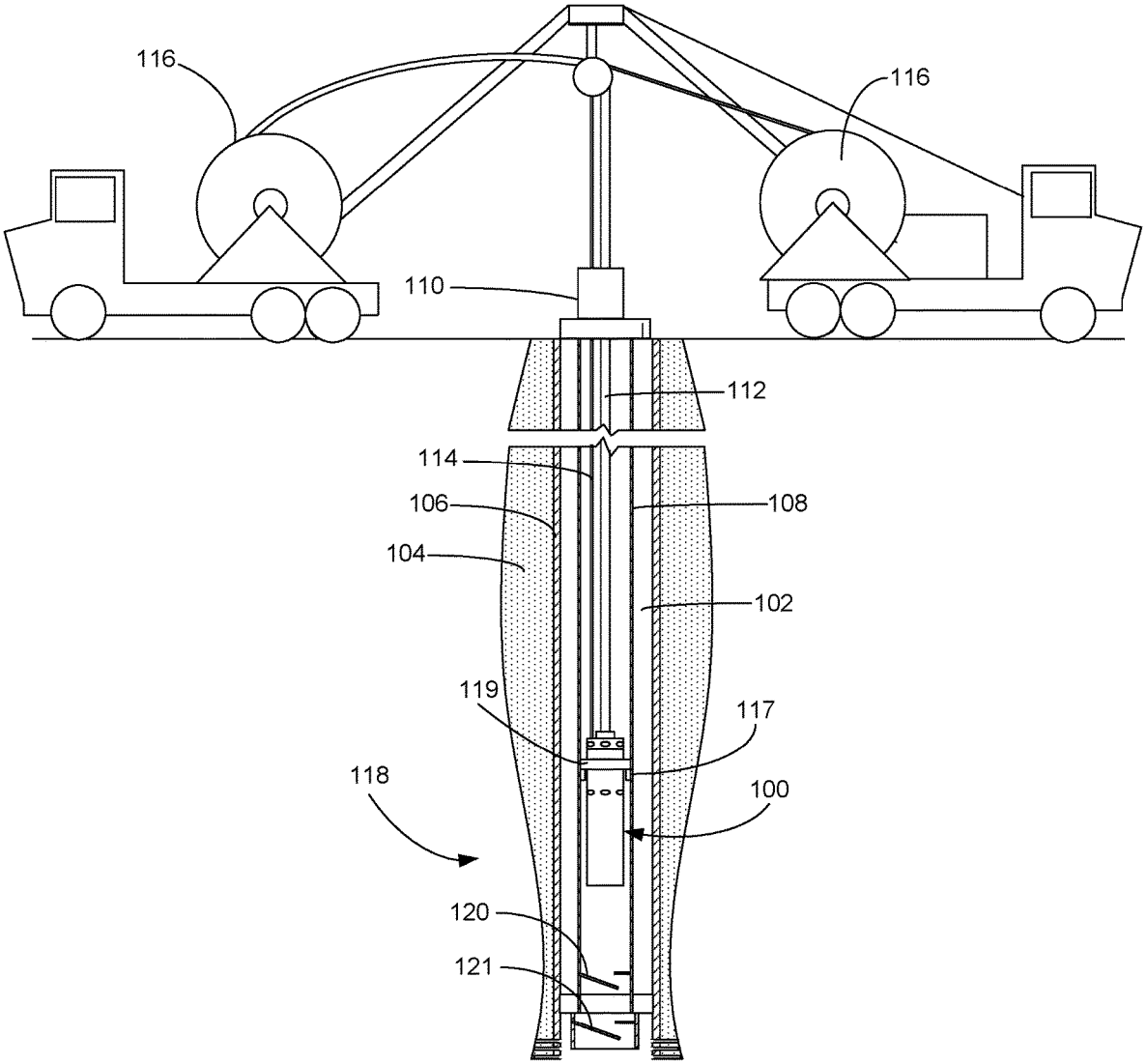
FIG. 1 is an elevational view of the deployment of an electric submersible pumping system with a wireline deployment system with a first landing assembly.

In accordance with exemplary embodiments of the present invention, FIG. 1 shows an elevational view of an electric submersible pumping system 100 being deployed in a wellbore 102 within a subterranean formation 104. The wellbore 102 includes a casing 106, production tubing 108 and a wellhead assembly 110. The pumping system 100 includes an electric motor and a pump driven by the electric motor.

Figure 2:
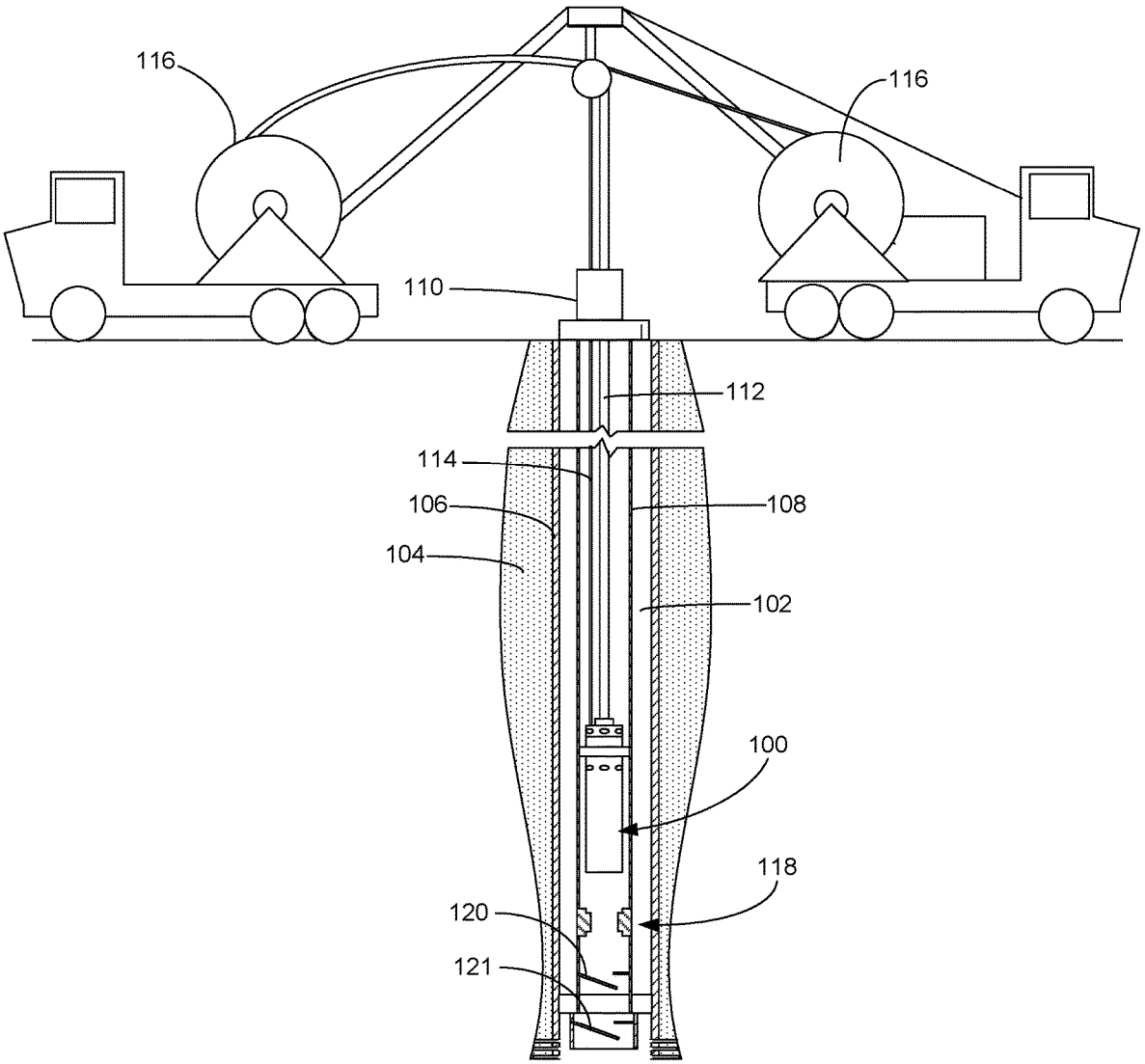
FIG. 2 is an elevational view of the deployment of an electric submersible pumping system with a wireline deployment system with a second landing assembly.

Electric power is supplied to the pumping system 100 through a self-supporting power cable 112. In the embodiments depicted in FIGS. 1 and 2, the power cable 112 is attached to the discharge end of the pump within the pumping system 100 and the cable runs along the outside of the pump to the motor. In other embodiments, the motor is placed above the pump within the pumping system 100 and the power cable 112 is connected directly to the motor. It will be appreciated that the pumping system 100 may include additional components. For example, the pumping system 100 may include a seal section, gas separators, sensor modules and other components known in the art.

The pumping system 100 is deployed within the production tubing 108 with a wireline 114. The wireline 114 and power cable 112 are controllably extended into the wellbore 102 from one or more spools 116 located at the surface. The spools 116 may be mounted on mobile cranes (as depicted in FIG. 1). Similarly, the spools 116 can be mounted in a fixed position relative to the wellhead assembly 110. Although the pumping system 100 is depicted in use with an inland wellbore 102, it will be appreciated that the pumping system 100 can also be used and deployed in offshore applications.

The production tubing 108 includes a landing assembly 118 disposed within the production tubing 108 to support the pumping system 100. In the embodiment depicted in FIG. 1, the landing assembly 118 comprises a landing collar 117 that catches a corresponding flange 119 on the pumping system 100. In this way, the pumping system 100 hangs from the landing collar 117. In contrast, in the embodiment depicted in FIG. 2, the landing assembly 118 comprises a landing nipple disposed near the lower end of the production tubing 108. The use of an upper landing assembly 118 places the pumping system 100 in under a tension load, while the use of a lower landing assembly 118 will cause the weight of the pumping system 100 to be carried as a compressive load. The use of the lower landing assembly 118 will permit the deployment of pumping systems 100 that closely approximate the size of the production tubing 108 because the pumping system 100 does not need to extend through a landing collar.

The landing assembly 118 provides support for the pumping system 100 and may include a deep set subsurface safety valve (SSSV) 120. The subsurface safety valve 120 is designed to be fail-safe, so that the wellbore 102 is isolated in the event of any system failure or damage to the surface production-control facilities. A flow control valve 121 can be positioned below the subsurface safety valve 120 can be selectively adjusted to permit flow into the production tubing 108 from the wellbore 102.

Figure 3:
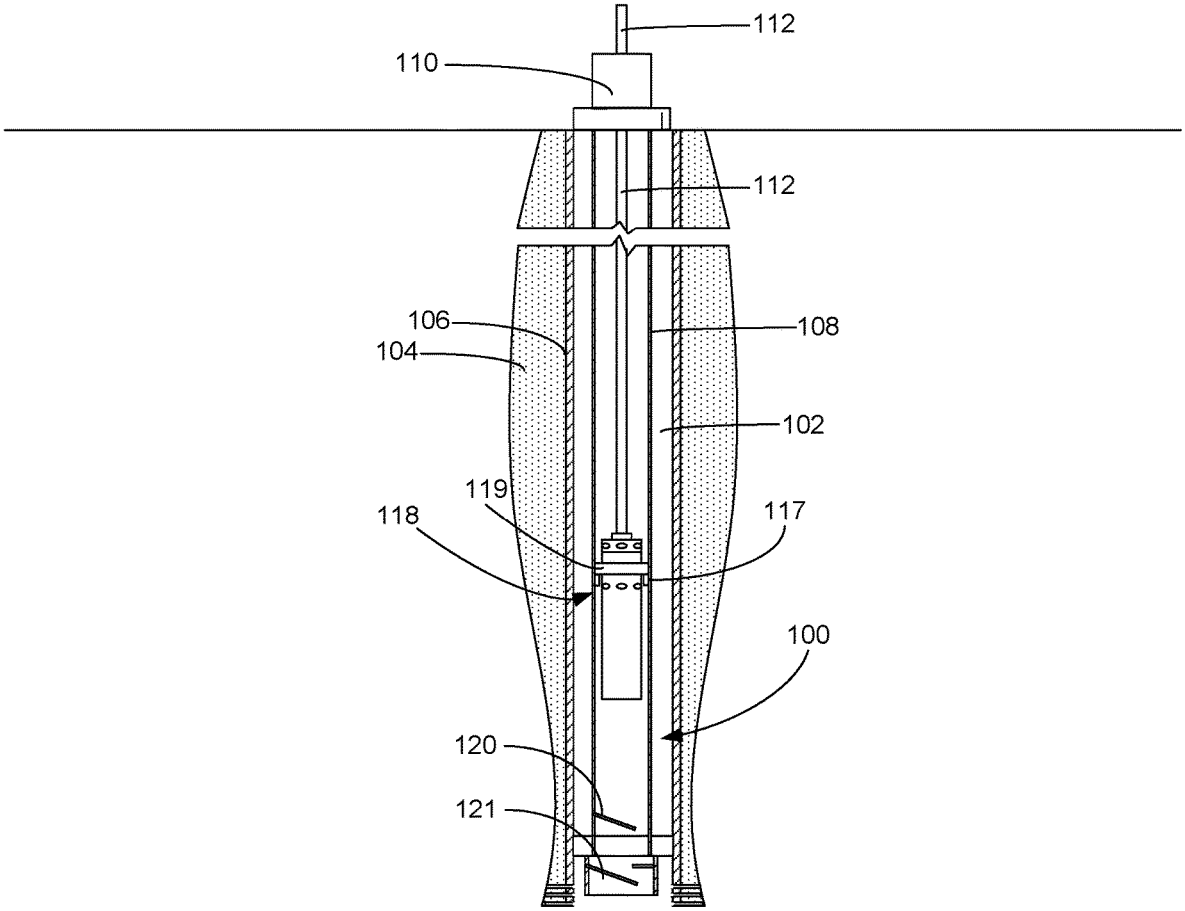
FIG. 3 is an elevational view of an electric submersible pumping system deployed with a wireline deployment system.

As illustrated in FIG. 3, once the pumping system 100 has been engaged with the landing assembly 118, the wireline 114 can be retrieved from the wellbore 102. Significantly, the self-supporting power cable 112 remains connected to the pumping system 100 and unconnected to the production tubing 108. Because the power cable 112 is not banded to the wireline 114 for support, the wireline 114 can be removed from the wellbore to prevent corrosion of the wireline 114. Additionally, because the power cable 112 is connected to the pumping system 100 before deployment, the power cable 112 and pumping system 110 do not make a wet connection within the wellbore 102.

In another embodiment, the pumping system 100 is lowered to the landing assembly 118 with only the wireline 114 attached to the pumping system 100. Once the pumping system 100 is supported by the landing assembly 118, the wireline 114 can be retrieved from the wellbore 102. The power cable 112 can then be lowered through the wellbore 102 and connected in situ to the pumping system 100. Extending the wireline 114 and power cable 112 into the wellbore 102 at different times simplifies the construction of the wellhead assembly 110.

Figure 4:
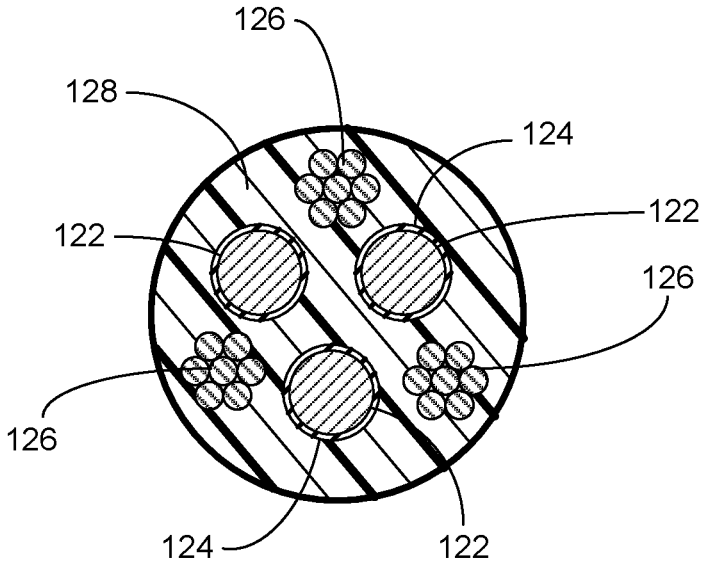
FIG. 4 is a cross-sectional view of a first embodiment of the self-supporting cable.
Figure 5:
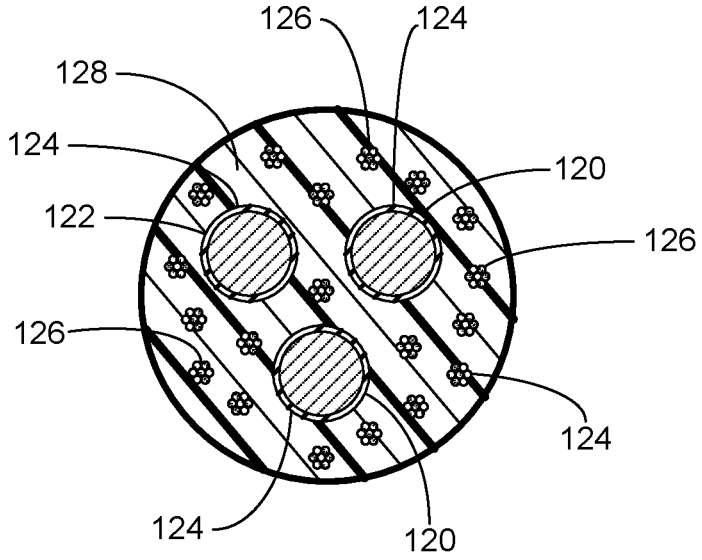
FIG. 5 is a cross-sectional view of a second embodiment of the self-supporting cable.

Turning to FIGS. 4 and 5, shown therein are perspective views, respectively, of alternate embodiments of the self-supporting power cable 112. In the embodiment depicted in FIG. 4, the power cable 112 includes three copper conductors 122 configured to deliver electrical power to the motor within the pumping system 100. The conductors 122 include an insulating sheath 124. The insulating sheath may be constructed from polypropylene or other polymer that exhibits favorable stability under elevated temperatures. In this embodiment, the power cable 112 further includes three braided steel cables 126 that provide tensile strength to the power cable 112. In the embodiment depicted in FIG. 5, the power cable 112 includes a larger number of smaller braided steel cables 126. The braided steel cables 126 may be oriented such that the individual strands within some of the steel cables 126 are wound in opposite direction to the strands in other steel conductors to minimize torsional forces when the braided steel cables 126 are exposed to tension. In both embodiments, the power cable 112 includes an abrasion resistant external jacket 128. The jacket 128 can be constructed from a thermally stable polymer.

Thus, the self-supporting power cable 112 generally includes both electrical conductors and strength members that support the weight of the power cable 112 in the wellbore 102. Although the wireline 114 can be used to deploy and retrieve the pumping system 100, in some embodiments, the power cable 112 may be sufficiently strong to reliably support the combined weight of the pumping system 100 and the power cable 112. Under these circumstances, the pumping system 100 can be deployed within the production tubing 108 with only the power cable 112.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts and steps within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A method of deploying and retrieving a submersible pumping system in production tubing within a wellbore, the method comprising the steps of:

connecting a wireline to the submersible pumping system;

lowering the submersible pumping system into the production tubing, wherein the weight of the submersible pumping system is borne by the wireline during the descent;

locating the submersible pumping system on a landing assembly;

disconnecting the wireline from the submersible pumping system;

retrieving the wireline from the submersible pumping system;

lowering a self-supporting power cable to the submersible pumping system;

connecting the self-supporting power cable to the submersible pumping system; and providing electric current to the submersible pumping system through the self-supporting power cable.

2. The method of claim 1, further comprising the step of retrieving the submersible pumping system from the wellbore.

3. The method of claim 2, wherein the step of retrieving the submersible pumping system from the wellbore comprises the step of lifting the submersible pumping system with the self-supporting power cable.

4. The method of claim 2, wherein the step of retrieving the submersible pumping system comprises:

lowering a wireline to the submersible pumping system;

connecting the wireline to the submersible pumping system; and lifting the submersible pumping system out of the wellbore with the wireline.

5. The method of claim 1, further comprising the steps of:

releasing the self-supporting power cable from the submersible pumping system;

retrieving the self-supporting power cable from the wellbore; and retrieving the submersible pumping system from the wellbore.

6. The method of claim 5, wherein the step of retrieving the submersible pumping system further comprises:

lowering a wireline to the submersible pumping system;

connecting the wireline to the submersible pumping system; and lifting the submersible pumping system out of the wellbore with the wireline.

7. The method of claim 1, wherein the step of locating the submersible pumping system on a landing assembly comprises contacting a landing flange near an upper end on the submersible pumping system on a landing collar within the production tubing.

8. The method of claim 1, wherein the step of locating the submersible pumping system on a landing assembly comprises contacting a landing assembly near a lower end of the production tubing with a lower end of the submersible pumping system.

* * * * *